US006565154B2

(12) United States Patent
Davis

(10) Patent No.: US 6,565,154 B2
(45) Date of Patent: May 20, 2003

(54) PORTABLE FORWARD LEANING STADIUM SEAT

(76) Inventor: Barton Brett Davis, 7608 Parkwood Dr. NW., Albuquerque, NM (US) 87120

( * ) Notice: Subject to any disclaimer, the term of this patent is extended or adjusted under 35 U.S.C. 154(b) by 0 days.

(21) Appl. No.: 09/820,391

(22) Filed: Mar. 28, 2001

(65) Prior Publication Data

US 2002/0140265 A1 Oct. 3, 2002

(51) Int. Cl.[7] ..... A47C 15/00

(52) U.S. Cl. ..... 297/352; 297/250.1; 297/256.13; 297/487; 297/488

(58) Field of Search ..... 297/250.1, 352, 297/256.15, 487, 488, 376

(56) References Cited

U.S. PATENT DOCUMENTS 3,026,142 A * 3/1962 Holloway ..... 297/252
3,237,985 A * 3/1966 Goldberg ..... 297/256
3,994,529 A * 11/1976 Lippert ..... 297/252
4,611,852 A * 9/1986 Filer ..... 297/352
4,637,151 A * 1/1987 Love et al. ..... 40/584
4,715,652 A * 12/1987 Ward ..... 297/252
4,781,413 A * 11/1988 Shumack, Jr. ..... 297/252
4,871,209 A * 10/1989 Handelman ..... 297/378.1
4,930,838 A * 6/1990 Brabant ..... 297/184.14
5,067,771 A * 11/1991 Ellis ..... 297/378.1
5,190,344 A * 3/1993 Anderson et al. ..... 297/17
5,205,610 A * 4/1993 Reninger ..... 297/380
5,222,782 A * 6/1993 Shrader ..... 297/252
5,421,637 A * 6/1995 Lemburg ..... 297/188.01
5,516,193 A * 5/1996 Simpson ..... 297/252
5,518,296 A * 5/1996 Compardo ..... 297/378.1
5,580,130 A * 12/1996 Williams et al. ..... 297/352
5,697,628 A * 12/1997 Spear ..... 280/304.1
5,829,837 A * 11/1998 Reiersen ..... 297/352
5,857,751 A * 1/1999 Koledin ..... 297/487
5,915,783 A * 6/1999 McDowell et al. .... 297/180.12
5,944,379 A * 8/1999 Yates ..... 297/129

* cited by examiner

*Primary Examiner*—Peter M. Cuomo
*Assistant Examiner*—Stephanie Harris

(57) ABSTRACT

A portable forward leaning seating device to be used on a bleacher at sporting events to provide the user with superior support to that portion of his back which is most susceptible to fatigue and pain. The device consists of a padded seat (10) attached to a seat frame (12) which is securely attached to the bleacher by a spring loaded hook (42). The user sits on the padded seat (10) by facing the sporting event with the adjustable vertical support sleave (14) positioned between the user's thighs. The user rests his arms on the padded horizontal arm rests (16) which are positioned using the adjusting knob (32) and spring loaded tab (38) in such a way to provide comfortable support to the torso of the user in a forward leaning fashion. The lock clasp (20) serves to lock the vertical support armature (18) securely in place.

20 Claims, 2 Drawing Sheets

PORTABLE FORWARD LEANING STADIUM SEAT

CROSS REFERENCES TO RELATED APPLICATIONS

Not Applicable

BACKGROUND

1. Field of Invention

This invention relates to portable seating devices, and in particular to a portable stadium seat apparatus that is to be used by individuals attending spectator events at facilities having backless bench type seats.

2. Description of Prior Art

There have been a number of attempts to develope a comfortable and easy to carry portable seat for spectator events with varying success. Traditional portable stadium seats have attempted to supply support to the human back while sifting at sporting events by utilizing a rearward leaning back rest. The following patents are examples of such rearward leaning portable stadium seats. U.S. Pat. No. 5,516,193 to Barry K. Simpson (May 14, 1996) U.S. Pat. No. 4,715,652 to James F. Ward (Dec. 29, 1987) U.S. Pat. No. 5,829,837 to Reiersen; Ronald G. (Nov. 3, 1998) U.S. Pat. No. 5,421,637 to Lemburg; Timothy R. (Jun. 6, 1995) U.S. Pat. No. 5,222,782 to Shrader, Stacy J. (Jun. 29, 1993) U.S. Pat. No. 4,871,209 to Handelman; Robert I. (Oct. 3, 1989) U.S. Pat. No. 4,781,413 to Shumack, Jr.; George J. (Nov. 11, 1988) U.S. Pat. No. 4,637,151 to Love; Samuel D. (Jan. 20, 1987) U.S. Pat. No. 5,944,379 to Yates; Donald (Sep. 31, 1999) U.S. Pat. No. 4,611,852 to Filer; Paul G. (Sep. 16, 1986) U.S. Pat. No. 5,190,344 to Anderson; Richard (Mar. 2, 1993) U.S. Pat. No. 3,994,529 to Lippert, Albert H. (Nov. 30, 1976) U.S. Pat. No. 5,580,130 to Williams; Gilbert J., et al. (Dec. 3, 1996) U.S. Pat. No. 5,067,771 to Ellis; Christopher M. (Nov. 26, 1991) U.S. Pat. No. 5,915,783 to McDowell; Kieth (Jun. 29, 1999) U.S. Pat. No. 4,930,838 to Brabant, Omer E. (Jun. 5, 1990) U.S. Pat. No. 5,518,296 to Compardo; Fred (May 21, 1996). Although rearward leaning backrests are efficacious in allowing the postural supporting muscles of the human torso to rest while sifting in a standard chair, they have not proven effective in allowing the user of portable stadium seats to comfortably sit in a supported posture at sporting events. The spectator sifting above a sporting event in a stadium of backless bleacher style seats typically leans forward to look down on the event. A portable seating apparatus with a back support does not support such a forward leaning posture.

What is needed is a portable personal stadium seat apparatus that is designed to be used with any type backless bench style seat and provide a solid attachment to the bench and provide a means of support to protect and minimize midback stress and pain consistant with overstretching (straining) of the lower trapezius musculature and midtrunk extensor mechanism, by supporting the users torso in a forward leaning position rather than a backward leaning position. Traditional rearward leaning portable stadium seats cannot support the midback musculature (the source of back pain) as the seat back apparatus is too short and the typical posture used to view sporting events while seated on bleacher type seating is to lean forward, not backward, by resting the user's forearms on his knees.

This new device will provide trunk support without the use of a traditional back rest. This trunk support will be adjustable to height and amount of reclinable attitude in order to accomodate differences in user physical dimensions or personal preferences, The trunk support will niether press the user forward into the person occupying the bench in front, nor project rearward obstructing the passageway or annoying the person behind. The trunk support also will not obstruct the passage of persons through the aisle the device is occupying. The new stadium seat will support the user's back/torso by allowing support of the trunk in a forward position rather than a traditional rearward leaning sitting posture. It is the object of this invention to demonstrate a portable stadium seat apparatus which avoids the disadvantages and limitations, recited above. Another object of this invention is to provide an apparatus that is simple to operate, extremely effective in alleviating midback pain, very cost effective, and be very adjustable and portable.

SUMMARY INCLUDING OBJECTS AND ADVANTAGES

In accordance with the present invention a portable forward leaning stadium seat comprises a seat frame connected to a padded seat, which can be firmly attached to a stadium style bleacher, an adjustable vertical support armature which has horizontal padded arm rests, and can be carried by a plastic handle.

OBJECTS AND ADVANTAGES

Accordingly, several objects and advantages of my invention are of an adjustable forward leaning support to allow the torso of spectators at sporting events to lean comfortably against, thereby minimizing back pain. The forward leaning designed stadium seat is portable, lightweight and adjustable to accomodate different sizes of users as well as different postural requirements of the user.

Still further objects and advantages will become apparent from a consideration of the ensuing description and accompanying drawings.

REFERENCE NUMERALS

Figure 1:
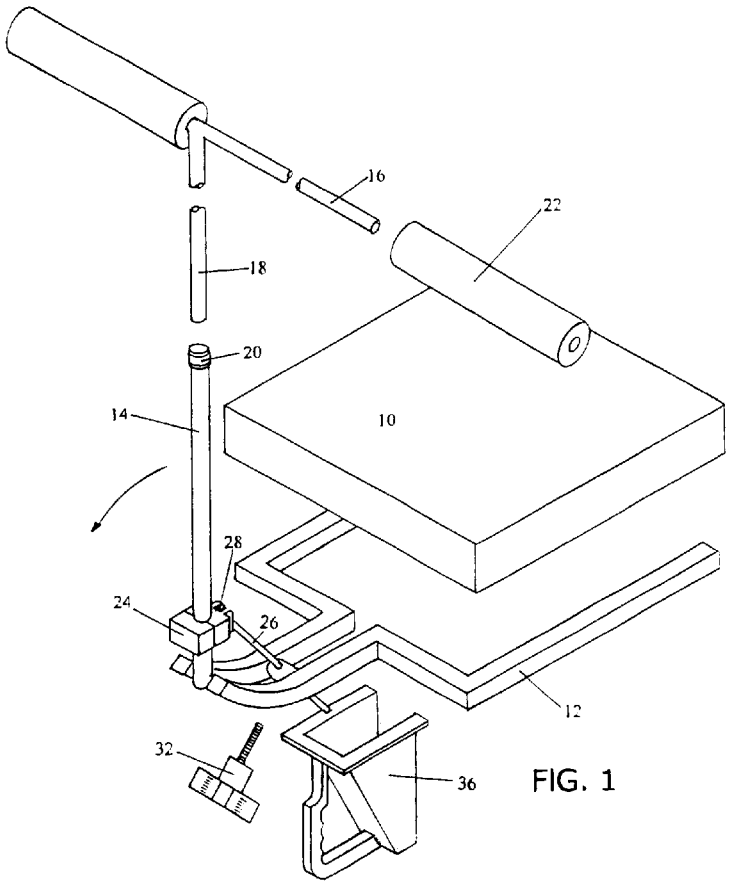
FIG. 1 is a perspective view of the invention showing the adjustable torso support armature in an upright posiiton with the foam seat not attached to the seat bracket.

10 padded foam seat
12 seat frame
14 vertical torso support sleeve
16 horizontal arm rest
18 vertical support armature
20 lock clasp
22 padded arm rests
24 two piece connecting bracket
26 adjustable slide rod
28 connecting rod
30 female threaded cylinder
32 adjusting knob

34 drilled holes
36 plastic handle
38 spring loaded tab
40 connecting dowel
42 spring loaded metal hook

PREFERRED EMBODIMENT—DESCRIPTION

Figure 2:
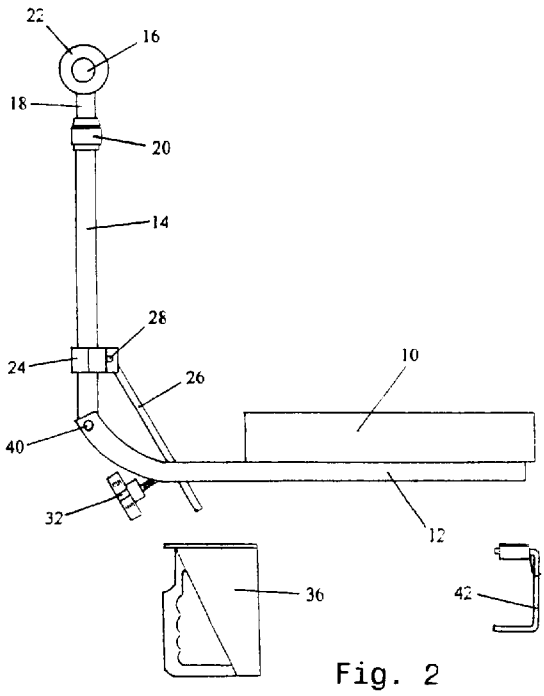
FIG. 2 is a side view of the portable forward leaning stadium seat demonstrating the plastic handle (36) and spring loaded hook (42).
Figure 3:
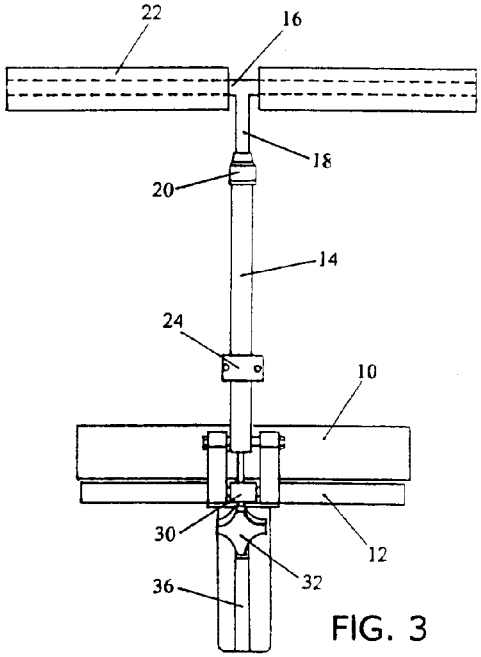
FIG. 3 shows an orthagonal front view of the portable forward leaning stadium seat with the adjustable torso rest in an upright position.
Figure 4:
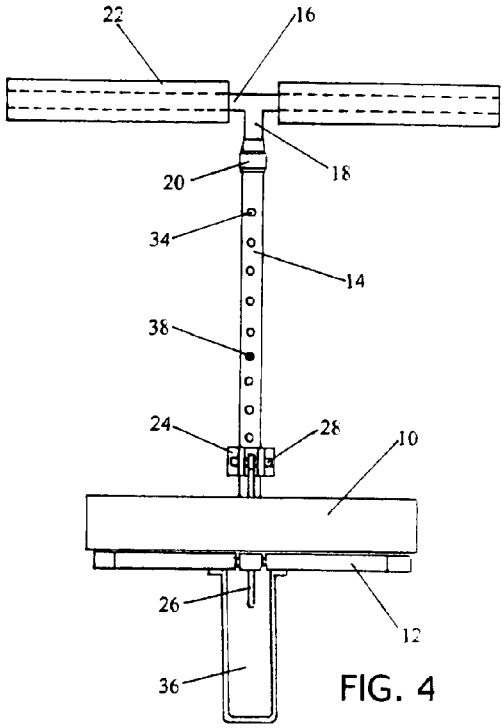
FIG. 4 is an orthagonal rear view of the portable forward leaning stadium seat with the adjustable torso support in the upright position.

As shown in FIG. 1, a covered padded foam seat (10) is attached to a seat frame (12) which has two projecting arms that are bent upward at its forward congruence and attaches to the vertical torso support sleeve (14) which has holes (34) drilled through one side. A spring loaded metal hook (42) is attached to the rear undersurface of the foam padded seat (10) with screws. The horizontal arm rest (16) has a vertical support armature (18) which slides into the vertical torso support sleeve (14) and can extend or collapse by loosening or tightening the lock clasp (20). The vertical support armature has a spring loaded tab (38) which locks into the drilled holes of the torso support sleeve (14). The horizontal arm rest (16) is covered by padded arm rests (22), which are removable for cleaning. The vertical upright sleeve (14) is attached to the seat frame (12) by a connecting dowel (40) which allows the vertical upright sleave to rotate freely about the dowel. The two piece connecting bracket (24) is attached to the vertical upright torso support sleeve (14) by nuts and bolts running on either side of the bracket into drilled and tapped holes. The connecting bracket (24) is attached to an adjustable slide rod (26) by a connecting rod (28). The adjustable slide rod (26) slides transversely through the female threaded cylinder (30) between the two projecting arms of the seat frame. The adjusting knob (32) is threaded and screwed into the female threaded cylinder (30) to lock the adjustable slide rod (26) in various positions. The plastic handle (36) houses the adjustable slide rod (26) and allows for easy carrying. FIG. 2 shows the side view clearly demonstrating the curved projection arms of the seat frame (12) with the vertical upright adjustable torso support sleave (14) and knob (28) assembly with plastic handle (36). Also shown is the spring loaded hook (42) which is attached to the back underside of the padded seat (10). FIG. 3 shows the front view of the forward leaning portable stadium seat showing the female threaded cylinder (30) and knob (32). Also shown is the connecting dowel (40) at the bottom end of the vertical adjustable torso support sleave (14). FIG. 4 shows the rear view which demonstrates the spring loaded tab (38) positioned into one of the drilled holes (34) which are drilled into the vertical support sleave (14) as well as the connecting rod (28) which holds the adjustable slide rod (26) onto the connecting bracket (24).

PREFERRED EMBODIMENT—OPERATION

Operation and use of the Portable Forward Leaning Stadium Seat is simple and straight forward. First connect the seat (10) to the bleacher by attaching the spring loaded hook (42) to the underside of the bleacher making sure that the horizontal arm rest (16) is facing toward the sporting event. Next, loosen the adjusting knob (32) and move the vertical torso support sleeve (14) into an open flexible position. Sit down on the padded seat (10) with the vertical support armature (18) positioned between the user's thighs. Pull the vertical arm rest assembly into the proper position (more or less vertical depending on the comfort of the user) and lock with the adjusting knob (32). Adjust the height of the horizontal arm rest (16) by loosening the lock clasp (20) and move the vertical support armature (18) by pressing the spring loaded tab (38) and moving it to the proper setting. Twist the lock clasp (20) back into a locked position. Place the forearms onto the horizontal arm rest pads (22), thereby supporting the user's torso.

CONCLUSIONS, RAMIFICATIONS, AND SCOPE

Accordingly, it can be seen that, according to the invention, I have provided a portable forward leaning seating device which allows a user a more comfortable method of supporting his/her torso to diminish back pain while sitting at sporting events on a bleacher type seat. Thereby, the ordinary rearward leaning seating device has been replaced with a comfortable, lightweight, portable, and affordable seating device which allows the user to more easily and comfortably view sporting events while leaning forward rather than leaning backward.

Although the description above contains many specificities, these should not be construed as limiting the scope of the invention but as merely providing illustrations of some of the presently preferred embodiments of this invention. Various other embodiments and ramifications are possible within it's scope. For example, the materials used to build the device can be of metal, plastic, vinyl, cloth, nylon, wood, synthetic, or composite. Further, the system used to provide for forward leaning support need not be limited by a single central vertical support armature (18), but may be provided by side support struts. Also, the horizontal arm/torso supports (16) need not be round, but may be flat or any other ergonomically shaped configuration. The padded sleeves (22) on the horizontal supports can be round or contoured in any ergonomic design. The assembly containing the two piece connecting bracket (24) connecting dowel (28) adjustable slide rod (26) female threaded cylinder (30) and adjusting knob (32) can be configured to allow anterior and posterior movement of the vertical support armature (18) utilizing cogs, gears, hydraulics, or springs.

Thus the scope of the invention should be determined by the appended claims and their legal equivalents, rather than by the examples given.

What is claimed is:

1. A portable forward leaning seating apparatus to be used at sporting events with stadium bleacher type seating, comprising:

A seat frame with a means to attach said seat frame to the undersurface of a padded seat.

A spring loaded hook device with a means to attach said spring loaded hook device to the rear undersurface of said padded seat whereby the said hook device attaches said padded seat to a stadium style bleacher.

At least a vertical support armature with a means to attach said vertical support armature to the front of said seat frame.

A hinge mechanism to permit said vertical support armature to swing freely about said seat frame in a prescribed forward and backward arc.

A horizontal arm rest device having a means to attach said horizontal arm rest to said vertical support armature.

An adjusting knob apparatus having a means to stop the forward and backward movement of said vertical support armature at prescibed locations within the prescribed arc of travel.

A handle device used for carrying said portable forward leaning seating device with a means to be attached to the undersurface of said seat frame which covers the adjustable slide rod.

2. The portable forward leaning seating apparatus of claim 1 wherein said seat frame comprises two separate lengths of metal tubing.

3. The portable forward leaning seating apparatus of claim 1 wherein said metal tubing is bent around and fastened to the lateral and front undersurface edges of said padded seat.

4. The portable forward leaning seating apparatus of claim 1 wherein said seat frame forms a forward upward bent projection whereby the vertical support sleave connects to the said seat frame by means of a nut and bolt.

5. The portable forward leaning seating apparatus of claim 1 wherein said padded seat comprises a rigid plank.

6. The portable forward leaning seating apparatus of claim 1 wherein said padded seat comprises foam padding covered by water proof material.

7. The portable forward leaning seating apparatus of claim 1 wherein said rigid plank has the physical dimensions congruent with stadium bleacher style seating.

8. The portable forward leaning seating apparatus of claim 1 wherein said vertical support armature is made of two prescribed lengths of metal tubing having different sized diameters whereby the smaller diameter length of said metal tubing slides into the larger diameter length of said metal tubing providing a means of lengthening and shortening said vertical support armature.

9. The portable forward leaning seating apparatus of claim 1 wherein the said larger diameter length of metal tubing provides small linearly placed equidistant holes on the rear facing surface to allow for seating of a spring loaded button attached to the said smaller diameter length of metal tubing to be slidably secured at different positions.

10. The portable forward leaning seating apparatus of claim 1 wherein the said smaller diameter length of metal tubing provides a spring loaded button.

11. The portable forward leaning seating apparatus of claim 1 wherein said vertical support armature is attached to forward most end of said forward upward bent projection of said seat frame by means of a nut and bolt.

12. The portable forward leaning seating apparatus of claim 1 wherein the horizontal arm rest device is fastened to the vertical support armature and whose length is of an average seating space provided at stadiums of sporting venues.

13. The portable forward leaning seating apparatus of claim 1 wherein the horizontal arm rest device is covered in foam padding from the point where the said arm rest is fastened to the vertical support armature extending to the ends of said arm rest and further where said padding is covered with a water proof material.

14. The portable forward leaning seating apparatus of claim 1 wherein the said adjusting knob device provides a male threaded knob which is threadedly mated transversely with a female threaded metal cylinder.

15. The portable forward leaning seating apparatus of claim 1 wherein the ends of said female threaded cylinder are of a smaller diameter than the female threaded body of said cylinder which is fitted in holes between the said forward upward bent projection of said seat frame.

16. The portable forward leaning seating apparatus of claim 1 wherein an adjustable slide rod of prescribed length and diameter slides through a matching hole in the said female threaded cylinder at a right angle to the said male threaded knob.

17. The portable forward leaning seating apparatus of claim 1 wherein a round metal dowel adaptor donut is fastened to one end of the said adjustable slide rod.

18. The portable forward leaning seating apparatus of claim 1 wherein the said round metal dowel adapter donut attached to said connecting rod is fastened by a dowel to the two piece connecting bracket.

19. The portable forward leaning seating apparatus of claim 1 wherein a handle device used for carrying said portable seat is made of plastic.

20. The portable forward leaning seating apparatus of claim 1 wherein said adjustable slide rod slides into said handle device when said vertical support armature is folded in a closed position for transport.

* * * * *